United States Patent [19]

Agarwala et al.

[11] Patent Number: 4,990,876

[45] Date of Patent: Feb. 5, 1991

[54] MAGNETIC BRUSH, INNER CORE THEREFOR, AND METHOD FOR MAKING SUCH CORE

[75] Inventors: Ashok K. Agarwala, Penfield; Bijay S. Saha, Rochester, both of N.Y.

[73] Assignee: Eastman Kodak Company, Rochester, N.Y.

[21] Appl. No.: 408,351

[22] Filed: Sep. 15, 1989

[51] Int. Cl.[5] ..... H01F 1/00; H01F 3/00

[52] U.S. Cl. ..... 335/297; 335/296

[58] Field of Search ..... 335/296, 297, 299, 302, 335/303, 306

[56] References Cited

U.S. PATENT DOCUMENTS

| | | | |
|---|---|---|---|
| 3,576,672 | 4/1971 | Harris et al. . | |
| 3,644,191 | 2/1972 | Matsushima | 204/298 |
| 3,942,230 | 3/1976 | Nalband | 204/298 |
| 3,969,644 | 7/1976 | Nowak | 335/306 |
| 4,076,640 | 2/1978 | Forgensi et al. . | |
| 4,152,223 | 5/1979 | Wallace et al. . | |
| 4,172,155 | 10/1979 | Pease . | |
| 4,246,323 | 1/1981 | Bornstein et al. . | |
| 4,264,698 | 4/1981 | Takayama et al. . | |
| 4,275,090 | 6/1981 | McComas et al. . | |
| 4,275,124 | 6/1981 | McComas et al. . | |
| 4,382,976 | 5/1983 | Restall . | |
| 4,393,326 | 7/1983 | Kamegaya et al. . | |
| 4,422,749 | 12/1983 | Hoshino et al. . | |
| 4,451,496 | 5/1984 | Gedwill et al. . | |
| 4,492,845 | 1/1985 | Kljuchko et al. . | |
| 4,546,060 | 10/1985 | Miskinis et al. . | |
| 4,547,758 | 10/1985 | Shimizu et al. | 335/302 |
| 4,585,473 | 4/1986 | Narasimhan et al. . | |
| 4,614,929 | 9/1986 | Tsukuda et al. | 335/302 |
| 4,684,406 | 8/1987 | Matsuura et al. . | |
| 4,687,510 | 8/1987 | Cheney et al. . | |
| 4,689,163 | 8/1987 | Yamashita et al. . | |
| 4,710,239 | 12/1987 | Lee et al. . | |
| 4,721,538 | 1/1988 | Narasimhan et al. . | |
| 4,781,754 | 11/1988 | Soranno et al. | 148/304 |
| 4,867,809 | 9/1989 | Haverstick | 148/105 |

FOREIGN PATENT DOCUMENTS

| | | | |
|---|---|---|---|
| 190461 | 8/1986 | European Pat. Off. . | |
| 0109860 | 10/1987 | European Pat. Off. . | |
| 255816 | 2/1988 | European Pat. Off. . | |
| 3735162 | 4/1988 | Fed. Rep. of Germany . | |
| 0098814 | 7/1980 | Japan | 335/296 |
| 027941 | 2/1983 | Japan . | |
| 168603 | 9/1984 | Japan . | |

(List continued on next page.)

OTHER PUBLICATIONS

"Current Patent Situation in the Field of the New Permanent Magnet Material NdFeB", C. Herget, Th. Goldschmidt AG, Essen, pp. 441–457.

Fiz. Met. & Metalloved. (USSR) vol. 51, No. 3, pp. 663–666, Mar. 1981, 6 Ref. Taken from Phys. Met. & Metalogr.

"Plasma Sprayed $Fe_{76}Nd_{16}N_8$ Permanent Magnets", R. A. Overfelt et al., Appl. Phys. Lett. vol. 49, No. 26, pp. 1799–1801, Dec. 29, 1986.

*Primary Examiner*—Steven L. Stephan
*Assistant Examiner*—Niloy H. Vyas
*Attorney, Agent, or Firm*—Dressler, Goldsmith, Shore, Sutker & Milnamow, Ltd.

[57] ABSTRACT

A magnetic brush useful in an electrophotographic apparatus. An outer sleeve is made of non-magnetic metal. An inner core is disposed within the outer sleeve so as to permit relative rotation of the inner core and the outer sleeve. The inner core comprises a shaft, which is made of magnetic or non-magnetic metal, and a magnetic layer covering a generally cylindrical surface of the shaft. The magnetic layer consists essentially of a plasma-sprayed alloy of iron, a rare earth, and boron. The rare earth is selected from the group consisting of neodymium, praseodymium, and mixtures thereof. Neodymium is preferred. A bonding layer may be optionally provided, preferably an alloy of nickel, chromium, aluminum, and yttrium.

9 Claims, 1 Drawing Sheet

FOREIGN PATENT DOCUMENTS

| | | | |
|---|---|---|---|
| 218619 | 12/1984 | Japan . | |
| 190562 | 9/1985 | Japan . | |
| 010208 | 1/1986 | Japan . | |
| 023172 | 1/1986 | Japan . | |
| 023173 | 1/1986 | Japan . | |
| 023174 | 1/1986 | Japan . | |
| 039507 | 2/1986 | Japan . | |
| 048904 | 3/1986 | Japan . | |
| 243152 | 10/1986 | Japan . | |
| 264157 | 11/1986 | Japan . | |
| 033402 | 2/1987 | Japan . | |
| 152108 | 7/1987 | Japan . | |
| 165312 | 7/1987 | Japan . | |
| 184323 | 8/1987 | Japan . | |
| 192566 | 8/1987 | Japan . | |
| 202505 | 9/1987 | Japan . | |
| 213102 | 9/1987 | Japan . | |
| 227061 | 10/1987 | Japan . | |
| 229803 | 10/1987 | Japan . | |
| 229804 | 10/1987 | Japan . | |
| 242316 | 10/1987 | Japan . | |
| 263235 | 11/1987 | Japan . | |
| 274046 | 11/1987 | Japan . | |
| 276823 | 12/1987 | Japan . | |
| 0185007 | 7/1988 | Japan | 335/302 |
| 0187603 | 8/1988 | Japan | 335/302 |
| 0099464 | 4/1989 | Japan | 335/303 |
| 278415 | 2/1969 | U.S.S.R. . | |
| 996980 | 2/1983 | U.S.S.R. . | |

MAGNETIC BRUSH, INNER CORE THEREFOR, AND METHOD FOR MAKING SUCH CORE

TECHNICAL FIELD OF THE INVENTION

This invention pertains to a magnetic brush useful in an electrophotographic apparatus, an inner core for such a brush, and an improved method for making such a core for such a brush.

BACKGROUND OF THE INVENTION

In electrophotographic apparatus, such as photocopiers, magnetic brushes are used to transport two-component developers. Two-component developers consist essentially of mixtures of toner particles and carrier particles. The toner particles are pigmented, resinous, non-magnetic particles. The carrier particles are magnetic particles, such as ferrite particles.

Typically, a magnetic brush comprises an outer sleeve, which is tubular, and an inner core, which is cylindrical. The inner core is disposed within the outer sleeve to permit relative rotation of the inner core and the outer sleeve about a common axis. The inner core and the outer sleeve may be independently rotatable in opposite rotational senses or in identical rotational senses. The outer sleeve is made of non-magnetic metal, which may be electrically conductive, such as non-magnetic stainless steel. The inner core is magnetized so as to exhibit a magnetic field with alternate north and south poles around the magnetic core.

The magnetic field exhibited by the inner core attracts the carrier particles to the outer surface of the outer sleeve. Opposite rotation of the outer sleeve and the inner core produces triboelectric forces, which cause the toner particles to adhere to the carrier particles. Such rotation also transports the carrier and toner particles around the outer surface of the outer sleeve, until the toner particles are stripped from the carrier particles, as by an electrostatic image on an image-recording surface near the outer sleeve.

A magnetic brush may be similarly used to transport a one-component developer. A one-component developer consists essentially of magnetic toner particles.

Miskinis et al. U.S. Pat. No. 4,546,060 illustrates and describes a magnetic brush and its operation with two-component developers. See, also, Paranjpe et al., A Magnetomechanical Model of the Magnetic Brush, *J. Appl. Phys.* 63(6), pp. 2136–2140 (1968).

In a magnetic brush of one known form in commercial use heretofore, the inner core comprises a shaft and a plurality of ceramic bar magnets. The magnets which are mounted adhesively along the shaft to exhibit a magnetic field with alternate north and south poles about the magnetic core.

Such a brush with ceramic bar magnets is bulky, and heavy, and requires motors with high torque. Fabrication of its inner core tends to be very inefficient. Such a brush cannot be easily accommodated in designing a compact unit of electrophotographic apparatus, such as a photocopier for desk-top use.

There has been a need, to which this invention is addressed, for a magnetic brush in an improved form, which can be compactly and efficiently made.

SUMMARY OF THE INVENTION

This invention provides a magnetic brush, which is useful in an electrophotographic apparatus, such as a photocopier. The magnetic brush comprises an outer sleeve and an inner core, which is disposed within the outer sleeve so as to permit relative rotation of the inner core and the outer sleeve about a common axis. The outer sleeve is made of non-magnetic material, preferably non-magnetic metal, such as non-magnetic stainless steel According to this invention, the inner core comprises a shaft having a generally cylindrical surface and a magnetic layer covering the generally cylindrical surface. The magnetic layer consists essentially of a plasma-sprayed alloy of iron, a rare earth, and boron. The rare earth is selected from the group consisting of neodymium, praseodymium, and mixtures thereof. Neodymium is preferred.

The shaft may be alternatively made of magnetic metal, such as carbon steel, or of non-magnetic metal, such as copper. Carbon steel is a preferred material for the shaft.

The alloy for the magnetic layer may be plasma-sprayed directly onto the generally cylindrical surface of the shaft. If so, it is preferred to blast the surface with grit particles, preferably with grit particles consisting essentially of silica particles, before the surface is covered with the magnetic layer. Such a blasting step promotes a good bond between the magnetizable layer and the blasted surface.

It can be contemplated by this invention to provide a bonding layer between the generally cylindrical surface of the shaft and the magnetic layer. The bonding layer, if provided, eliminates any need to blast the surface with grit particles before covering the surface with the magnetic layer. Preferably, the bonding layer comprises an alloy of nickel, chromium, aluminum, and yttrium.

These and other objects, features, and advantages of this invention are evident from the following description of preferred and alternative embodiments of this invention, with reference to the accompanying drawings

Figure 1:
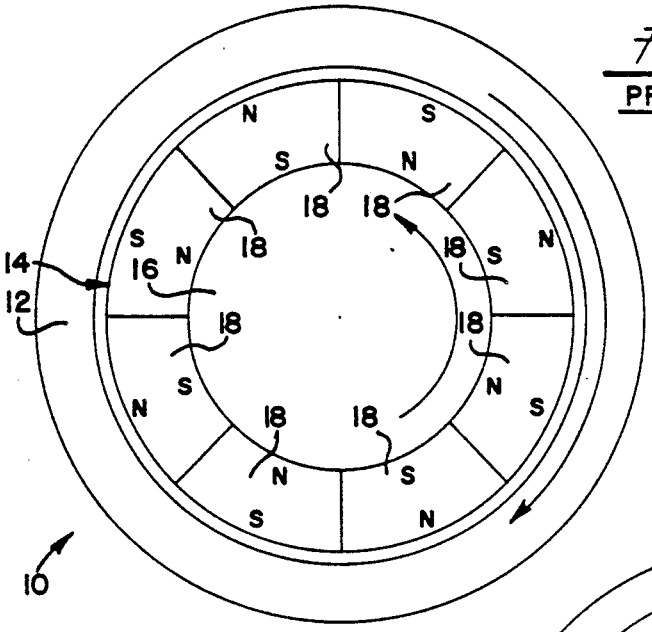
FIG. 1 PRIOR ART
FIG. 1 is a cross-sectional, diagrammatic view of a magnetic brush exemplifying prior art.

In the drawings, thicknesses of certain layers are exaggerated, so as to facilitate their illustration.

DETAILED DESCRIPTION OF ILLUSTRATED EMBODIMENTS

As shown in FIG. 1, magnetic brush 10 exemplifies prior art.

The magnetic brush 10 comprises an outer sleeve 12 and an inner core 14. The outer sleeve 12, which is tubular, is made of non-magnetic, electrically conductive metal, such as non-magnetic stainless steel. The inner core 14, which is cylindrical, is disposed within the outer sleeve 12 to permit relative rotation of the inner core 14 and the outer sleeve 12 about a common axis. An annular gap is defined between the outer sleeve 12 and the inner core 14. The inner core 14 and the outer sleeve 12 may be independently rotatable in opposite rotational senses, as indicated by curved arrows, or in identical rotational senses.

The inner core 14 comprises a shaft 16, which is made of carbon steel, and eight ceramic bar magnets 18, which are mounted adhesively along the shaft 16. The bar magnets 18 are arranged, as shown, to exhibit a magnetic field with alternate north and south poles around the core 14. It is known to use a greater, or lesser, but even number of such magnets.

Figure 2:
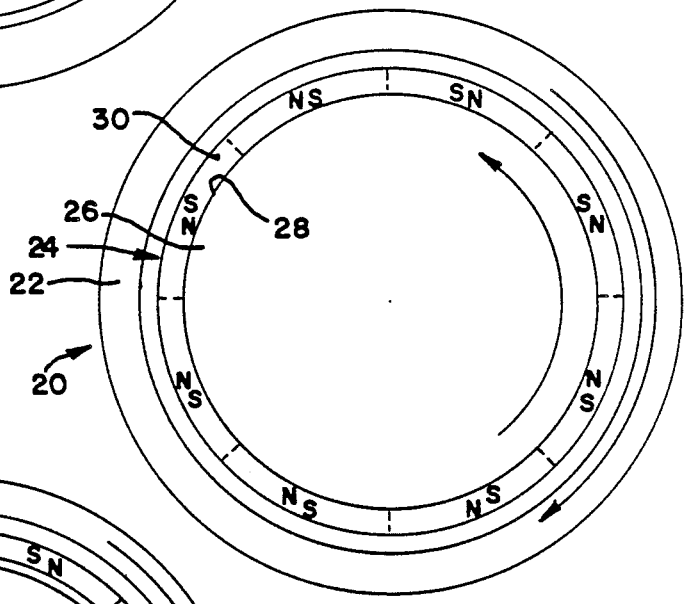
FIG. 2 is a cross-sectional, diagrammatic view of a magnetic brush constituting a preferred embodiment of this invention.

As shown in FIG. 2, magnetic brush 20 constitutes a preferred embodiment of this invention.

The magnetic brush 20 comprises an outer sleeve 22 and an inner core 24. The outer sleeve 22, which is tubular, is made of non-magnetic, electrically conductive material, preferably non-magnetic metal, such as non-magnetic stainless steel. The inner core 24, which is cylindrical, is disposed within the outer sleeve 22 so as to permit relative rotation of the inner core 24 and the outer sleeve 22 about a common axis. The inner core 24 and the outer sleeve 22 may be independently rotatable in opposite rotational senses, as indicated by curved arrows, or in identical rotational senses.

The inner core 24 comprises a shaft 26, which has a generally cylindrical surface 28, and a magnetic layer 30, which directly covers such surface 28. The magnetic layer 30 consists essentially of an alloy of iron, a rare earth, and boron, as applied by a plasma-spraying process described below. The rare earth is selected from the group consisting of neodymium, praseodymium, and mixtures thereof. An alloy of iron, neodymium, and boron (Fe-Nd-B) is preferred.

Suitable alloys for the magnetic layer 30 and their magnetic properties, that are excellent for purposes of the magnetic brush 20, are described in prior publications.

For example, Overfelt et al., Plasma Sprayed $Fe_{76}Nd_{16}B_8$ Permanent Magnets, *Appl. Phys. Lett.* 49 (26) pp. 1799–1801 discloses that an alloy, identified as $Fe_{76}Nd_{16}B_8$ can be plasma-sprayed onto a stainless steel substrate. Yamashita et al. U.S. Pat. No. 4,689,163, discloses that particles of such an alloy can be resin-bonded in making a magnet. European Patent Application No. 83304909.1 (Publication No. 108,474) discloses formulae for such alloys.

The alloy for the magnetic layer 30 is provided to the plasma-spraying process as a powder, which has been obtained by melt-spinning (melt-quenching) and milling. The powder has particle sizes within the range of from approximately 10 microns to approximately 400 microns and grain sizes that optimally range from approximately 0.2 micron to approximately 0.3 microns. The Yamashita et al. and European patent references noted above discuss melt-quenching such alloys.

Preferably, the shaft 26 is made of magnetic metal, such as carbon steel, whereupon the magnetic layer 30 can be relatively thin, e.g., of a thickness of approximately one millimeter. However, the shaft 26 may be alternatively made of non-magnetic metal, such as copper, whereupon the magnetic layer 30 may have to be relatively thick, e.g., of a thickness of approximately two millimeters.

Before the magnetic layer 30 is applied, the generally cylindrical surface 28 of the shaft 26 is prepared to promote a good bond between the magnetic layer 30 and the generally cylindrical surface 28 of the shaft 26. A preferred way to prepare the surface 28 is to blast the surface with grit particles. Preferably, the particles consist essentially of silica powder.

In the plasma-spraying process used to apply the magnetic layer 30, a plasma can be formed from a mixture of argon flowing at a rate of approximately 50 liters per minute and hydrogen flowing at a rate of approximately 8 liters per minute. Argon flowing at a rate of approximately two liters per minute can be used as a carrier gas to carry the alloy for the magnetic layer 30, as a powder with the particle and grain sizes specified above, into the plasma at a rate of about 40 grams per minute. Argon also can be used as a back-flushing gas. The gas flow rates specified above are specified at standard temperature and standard pressure. The gas and powder flow rates specified above are exemplary and may be widely varied.

In the plasma-spraying process described above, molten droplets of the alloy for the magnetic layer 30 are formed instantaneously. These droplets are sprayed, preferably over a distance of approximately 30 centimeters, so as to impinge on the generally cylindrical surface 28 of the shaft 26 at high velocities, whereupon they solidify instantaneously. Because the alloy for the magnetic layer 30 is oxidizable, these droplets are sprayed in a vacuum of approximately 60 millitorrs. Power consumption to sustain the plasma is approximately 35 kilowatts.

The magnetic layer 30 is magnetized so as to exhibit a magnetic field with alternate north and south poles in strip-like regions, as suggested by broken lines dividing the magnetic layer 30 into eight such regions, around the inner core 24. The magnetic layer 30 can have a greater, or lesser, but even number of such regions.

The magnetic layer 30 can be magnetized by known techniques for magnetizing rare earth-based magnets. One technique uses a magnetic field pulse, as generated in a wire-wound fixture, which conforms to the desired configuration of magnetic poles. Alternatively, the magnetic layer 30 can be magnetized by a recently developed technique disclosed in a co-pending application of A. K. Agarwala, U.S. patent application Ser. No. 301,687, which was filed on Jan. 26, 1989, and which is assigned commonly herewith.

The magnetic brush 20 can be compactly made. Thus, the outer shell 22 can have an outer diameter as small as approximately less than one inch. Also, the outer shell 22 can have an outer diameter as large as approximately eight inches The magnetic layer 30 has a thickness in a range of approximately less than one millimeter to several millimeters and can be thus regarded as a film. The magnetic brush 20 can have an overall length of approximately ten inches. These dimensions are exemplary, not limiting.

Because the plasma-spraying process specified above can be easily automated, the magnetic brush 20 can be efficiently made. There is no need to mount ceramic bar magnets adhesively to a shaft.

Figure 3:
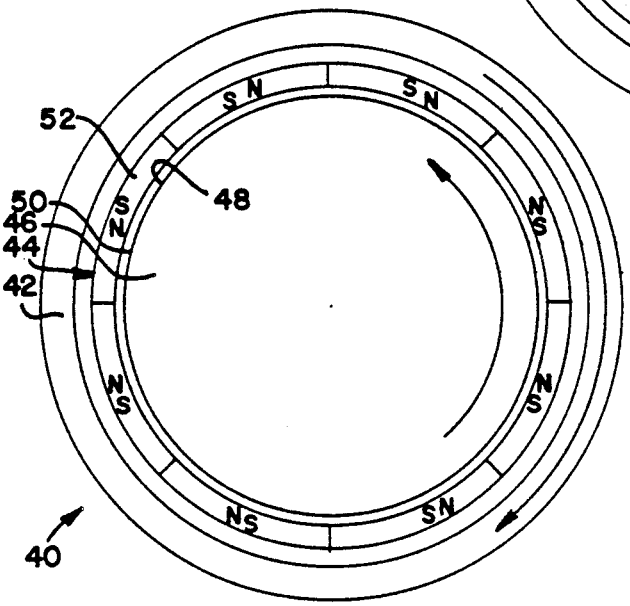
FIG. 3 is a cross-sectional, diagrammatic view of a magnetic brush constituting an alternative embodiment of this invention.

As shown in FIG. 3, magnetic brush 40 constitutes an alternative embodiment of this invention.

The magnetic brush 40 comprises an outer sleeve 42 and an inner core 44. The outer sleeve 42 is similar to the outer sleeve 22 of the magnetic brush 20. The inner core 24, which is cylindrical, is disposed within the outer sleeve 22, substantially as the inner core 24 of the magnetic brush 20 is disposed within the outer sleeve 22 of the magnetic brush 20, so as to permit relative rotation of the inner core 44 and the outer sleeve 42 about a common axis. The inner core 44 and the outer sleeve 42 may be independently rotatable in opposite rotational senses, as indicated by curved arrows, or in identical rotational senses.

The inner core 44 comprises a shaft 46, that is similar to the shaft 26 of the inner core 24 of the magnetic brush 20. The shaft 46 has a generally cylindrical surface 48. The inner core 44 also comprises a bonding layer 50, that directly covers surface 48, and a magnetic layer 52, that directly covers the bonding layer 50 and indirectly covers the surface 48.

Preferably, the bonding layer 50 consists essentially of an alloy of nickel, chromium, aluminum, and yttrium (Ni-Cr-Al-Y) which may be plasma-sprayed (or applied otherwise) directly onto the generally cylindrical surface 48 of the shaft 46. It is desirable but not necessary to prepare surface 48, by blasting surface 48 with grit particles as mentioned above, before plasma-spraying the alloy for the bonding layer 50.

Plasma-sprayed alloys of nickel, chromium, aluminum, and yttrium (Ni-Cr-Al-Y) have been known heretofore. Examples of such alloys are disclosed in Wallace et al. U.S. Pat. No. 4,152,223.

After the bonding layer 50 has been applied to a sufficient thickness, e.g., a thickness of approximately 100 microns to approximately 200 microns, the magnetic layer 52 is applied. The magnetic layer 52 is similar to the magnetic layer 30 of the inner core 24 of the magnetic brush 20, may be similarly applied by plasma spraying. The bonding layer 50 promotes a good bond between the magnetic layer 50 and the generally cylindrical surface 48 of the shaft 46.

The magnetic layer 52 is magnetized, as the magnetic layer 30 of the inner core 24 of the magnetic brush 20 is magnetized, so as to exhibit a magnetic field with alternate north and south poles in strip-like regions, suggested by broken lines dividing the magnetic layer 52 into eight such regions, around the inner core 44. The magnetic layer 52 can have a greater, or lesser, but even number of such regions Various modifications not disclosed herein may be also made without departing from the scope and spirit of this invention.

We claim:

1. A magnetic brush useful in electrophotographic apparatus, the magnetic brush comprising an outer sleeve, which is made of non-magnetic material, and an inner core, which is disposed within the outer sleeve to permit relative rotation of the inner core and the outer sleeve, the inner core comprising a shaft made from a magnetic material and having a generally cylindrical surface and a magnetic layer covering said surface, the magnetic layer comprising a plasma-sprayed alloy of iron, neodymium and boron wherein the inner core comprises a bonding layer between the generally cylindrical surface of the shaft and the magnetic layer.

2. The magnetic brush of claim 1 wherein the bonding layer comprises an alloy of nickel, chromium, aluminum, and yttrium.

3. A magnetic brush useful in electrophotographic apparatus, the magnetic brush comprising an outer sleeve, which is made of non-magnetic material, and an inner core, which is disposed within the outer sleeve to permit relative rotation of the inner core and the outer sleeve, the inner core comprising a shaft made from a non-magnetic material and having a generally cylindrical surface and a magnetic layer covering said surface, the magnetic layer comprising a plasma-sprayed alloy or iron, neodymium, and boron wherein the inner core comprises a bonding layer between the generally cylindrical surface of the shaft and the magnetic layer.

4. The magnetic brush of claim 3 wherein the bonding layer consists essentially of an alloy of nickel, chromium, aluminum, and yttrium.

5. An inner core for a magnetic brush useful in electrophotographic apparatus, the inner core comprising a shaft made from a magnetic metal and having a generally cylindrical surface and a magnetic layer covering the generally cylindrical surface of the shaft, the magnetic layer comprising of a plasma-sprayed alloy of iron, neodymium, and boron wherein the inner core comprises a bonding layer between the generally cylindrical surface of the shaft and the magnetic layer.

6. The inner core of claim 5 wherein the bonding layer comprises an alloy of nickel, chromium, aluminum, and yttrium.

7. An inner core for a magnetic brush useful in electrophotographic apparatus, the inner core comprising a shaft made from a non-magnetic metal and having a generally cylindrical surface and a magnetic layer covering the generally cylindrical surface of the shaft, the magnetic layer comprising of a plasma-sprayed alloy of iron, neodymium, and boron wherein the inner core comprises a bonding layer between the generally cylindrical surface of the shaft and the magnetic layer.

8. A method for making an inner core for a magnetic brush useful in electrophotographic apparatus, the method comprising steps of providing a shaft having a generally cylindrical surface, blasting the generally cylindrical surface of the shaft with grit particles before covering said surface with a magnetic layer and covering said surface with a magnetic layer by plasma-spraying said surface with an alloy of iron, a rare earth, and boron, wherein the rare earth is selected from the group consisting of neodymium, praseodymium, and mixtures thereof wherein the alloy for the magnetic layer is plasma-sprayed directly onto the generally cylindrical surface of the shaft.

9. A method for making an inner core for a magnetic brush useful in electrophotographic apparatus, the method comprising steps of providing a shaft having a generally cylindrical surface, providing a bonding layer on the generally cylindrical surface of the shaft before covering said surface with a magnetic layer and covering said surface with a magnetic layer by plasma-spraying said surface with an alloy of iron, a rare earth, and boron, wherein the rare earth is selected from the group consisting of neodymium, praseodymium, and mixtures thereof.

* * * * *